United States Patent [19]

Guerin

[11] Patent Number: 5,048,150

[45] Date of Patent: Sep. 17, 1991

[54] DOOR HOLDER

[75] Inventor: Phillip Guerin, Lawrence, Mass.

[73] Assignee: Professional Engineering Company Incorporated, Lawrence, Mass.

[21] Appl. No.: 471,558

[22] Filed: Jan. 29, 1990

[51] Int. Cl.[5] ..... E05F 5/00

[52] U.S. Cl. ..... 16/49; 16/82; 16/DIG. 17; 16/DIG. 9; 16/84; 16/66; 292/DIG. 25; 292/306; 292/275

[58] Field of Search ..... 16/49, 66, 82, 84, 85, 16/DIG. 9, DIG. 10, DIG. 17; 292/DIG. 12, DIG. 15, DIG. 19, 94, 225, 275, 306, 336.3, DIG. 25

[56] References Cited

U.S. PATENT DOCUMENTS

| | | | |
|---|---|---|---|
| 1,287,443 | 12/1918 | Rosentreter | 16/84 |
| 2,917,770 | 12/1959 | Etnyre | 16/82 |
| 3,105,264 | 10/1963 | Truhon | 16/66 |
| 4,136,899 | 1/1979 | Frasher | 292/DIG. 15 |
| 4,194,264 | 3/1980 | Stoffregen | 16/84 |
| 4,569,546 | 2/1986 | Howard et al. | 292/DIG. 15 |
| 4,621,848 | 11/1986 | Pierce | 292/DIG. 25 |
| 4,815,163 | 3/1989 | Simmons | 16/82 |
| 4,912,783 | 4/1990 | Shafer | 16/82 |

*Primary Examiner*—Richard K. Seidel
*Assistant Examiner*—Edward A. Brown
*Attorney, Agent, or Firm*—Wolf, Greenfield & Sacks

[57] ABSTRACT

A door holder that includes a holding member adapted to be secured between the door and a frame of the door. The holding member includes a lever that may be clamped in either a first released position in which the door is freed to be opened and closed or a second holding position in which the door is held open. A foot operated actuating means operated by a user controls the lever to move it into a clamping position to hold the door open.

24 Claims, 4 Drawing Sheets

DOOR HOLDER

BACKGROUND OF THE INVENTION

1. Field of the Invention

The present invention relates in general to a door holder. More particularly, the present invention relates to a mechanical device that is preferably foot actuated for holding a door in a partially or fully opened position.

Even more particularly, the present invention relates to a door holder in which actuating means are provided for holding the door in at least a partially opened position, preventing closing thereof but at the same time enabling further opening thereof.

2. Background Discussion

Many residential houses have, not only the normal house door, but also a storm or screen door. When an individual is carrying items such as bundles or the like, it is very difficult to provide for opening of both doors. This usually means that the bundles or packages have to be put down so that the doors can be opened. Many times one has to temporarily put an item in front of one or more of the doors to keep it open. This is time consuming.

Accordingly, it is an object of the present invention to provide a door holder that is actuable by a user to hold a door in a partially or fully opened position.

Another object of the present invention is to provide a door holder that can be used with, for example, a storm or screen door and which is preferably foot operated so that one can open the door, operate the holder and in this way maintain the door in an opened position.

Still another object of the present invention is to provide an automatic door holder that is preferably foot actuated and which can be operated by either mechanical or hydraulic means.

SUMMARY OF THE INVENTION

To accomplish the foregoing and other objects, features and advantages of the invention, there is provided a door holder that comprises a holding means. This holding means is secured at one end to the door and at the other end to a stationary position adjacent to the door. The holding means includes an actuable clamping means having a first released position in which the door is freely openable and closeable and a second holding position in which the door is held open. An actuating means is disposed remote from the holding means and is operable by a user to control the holding means to move the clamping means from its first position to its second holding position. The clamping means preferably is in the form of a lever member that is used in combination with a rod means that is adapted to be received by the lever member. The lever member preferably also has a binding plate that can lock the rod means once the actuating means is operated. This holds the door in a partially or fully open position. Also, in accordance with the present invention, the lever means is constructed so that, although the door is held in a partially open position and prevented from closing, it is possible to open the door further. When it is opened further, then it will continue to be clamped in this further opened position.

In accordance with further features of the present invention, the lever member may be secured directly to the door and may include a pivot piece. In accordance with another embodiment of the invention disclosed herein, there is provided means for securing the lever member to a door control piston unit. In either embodiment of the invention, there is provided a rod means that extends through the lever member with the lever member clamping the rod means in the aforementioned second position. The lever member clamps the rod means preferably only in one direction of the movement of the rod means to hold the door open but enable further opening thereof.

The actuating means preferably includes a foot operated actuating means. This may include a mat having cable means extending therefrom for operating the holding means. In an alternate embodiment of the invention, the foot operated actuating means may comprise hydraulic or pneumatic means for operating the holding means or lever means.

BRIEF DESCRIPTION OF THE DRAWINGS

Numerous other objects, features and advantages of the invention should now become apparent upon the reading of the following detailed description taken in conjunction with the accompanying drawings, in which.

DETAILED DESCRIPTION

Figure 7:
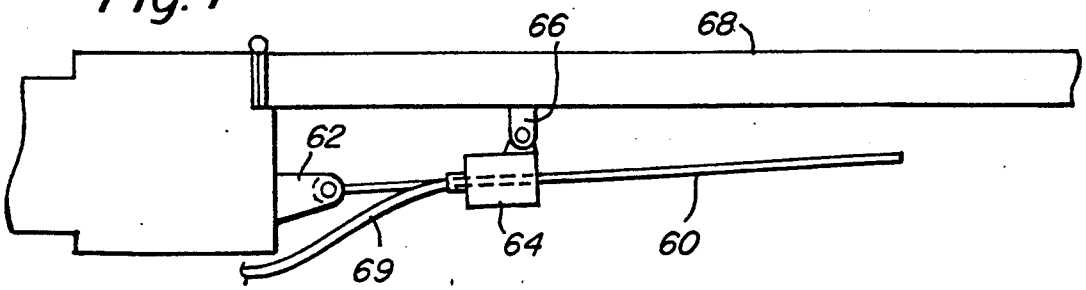
FIG. 7 is a schematic diagram of an alternate embodiment of the present invention.
Figure 8:
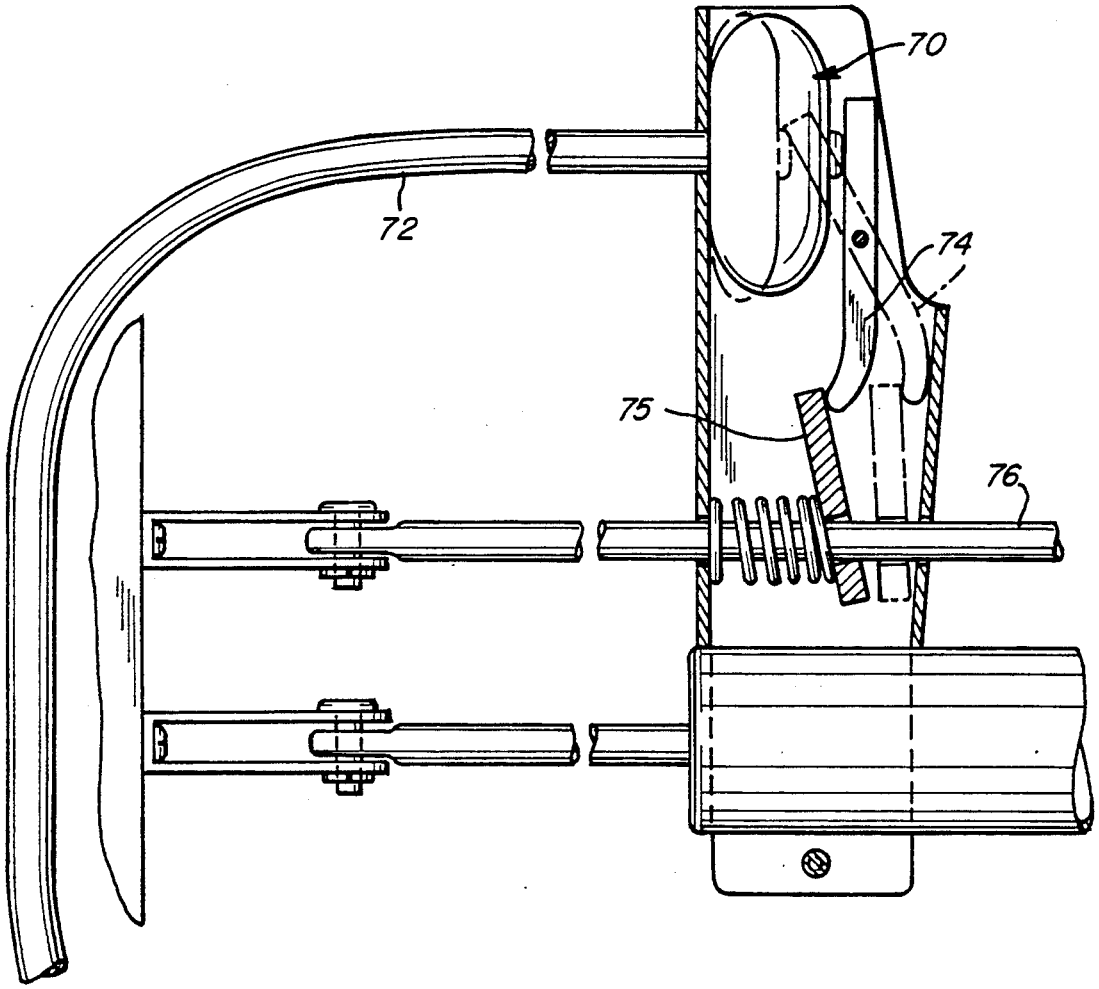
FIG. 8 is a fragmentary view showing an alternate form of actuating means that is hydraulic.
Figure 8:
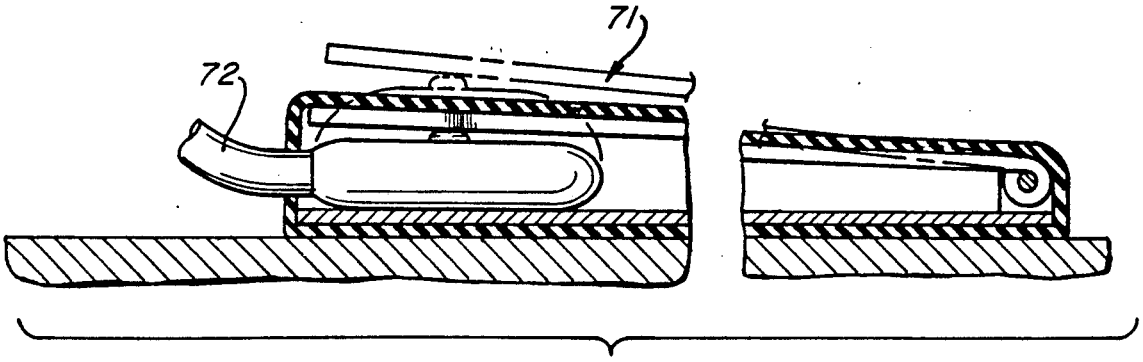

Reference is now made to the drawings herein. A first embodiment of the invention is illustrated in detail in FIGS. 1-6. An alternate embodiment of the invention is illustrated in FIG. 7. FIG. 8 illustrates a hydraulic version of the present invention.

Figure 1:
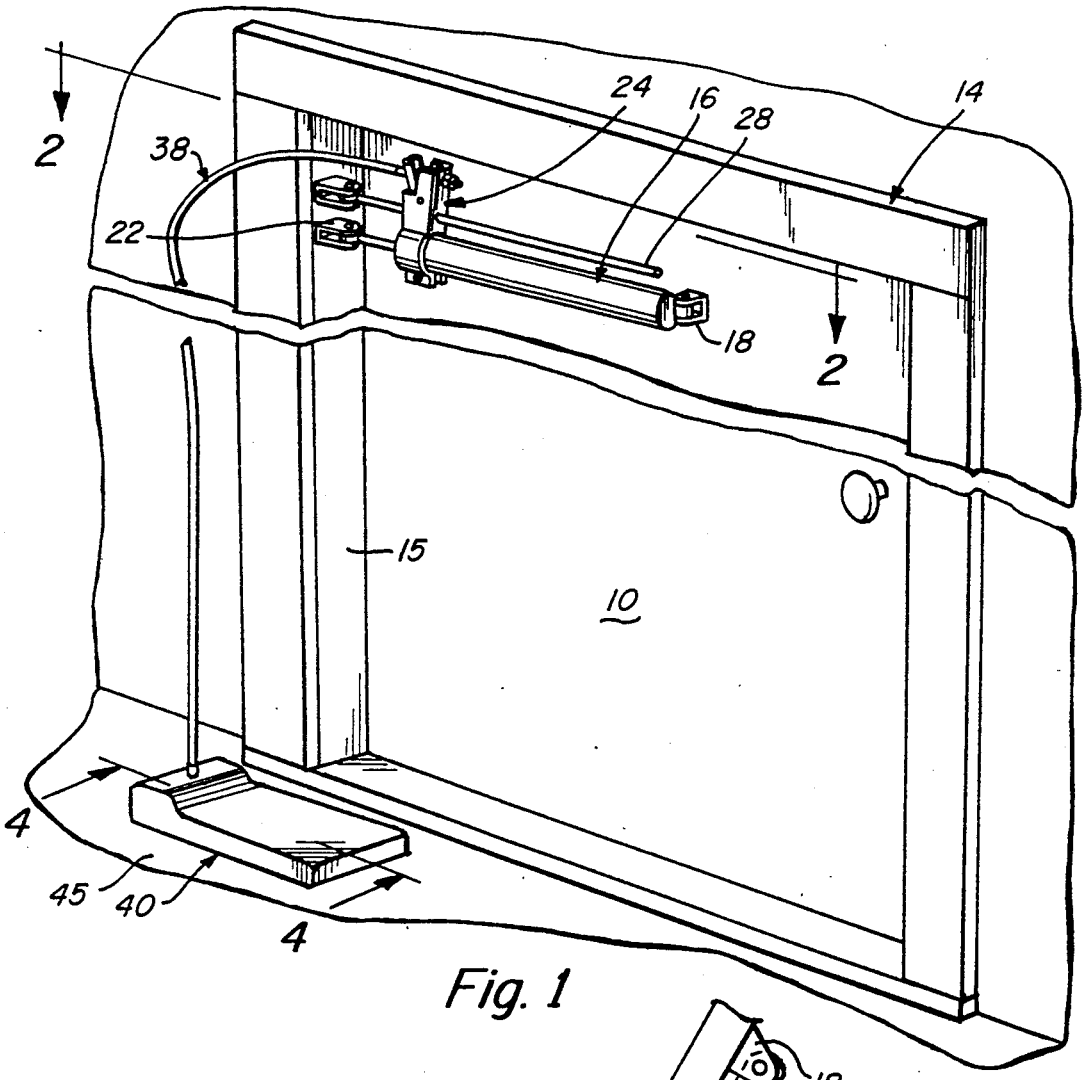
FIG. 1 is a prospective view of the door holder device of the present invention.
Figure 2:
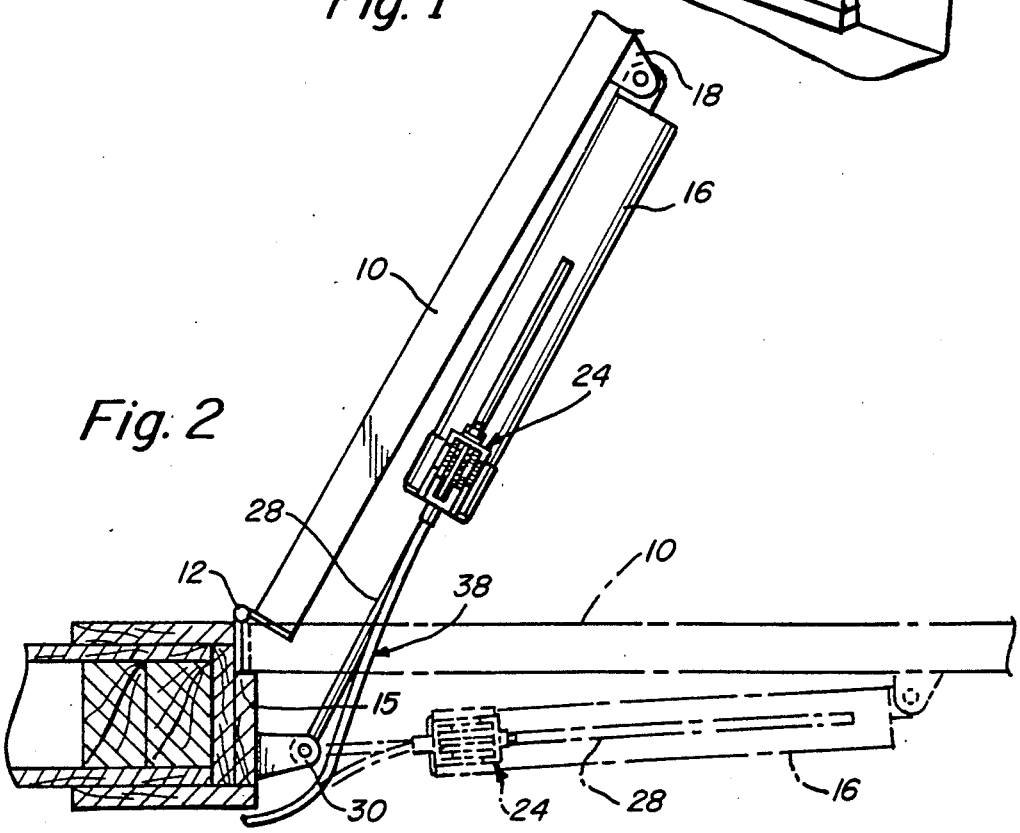
FIG. 2 is a cross-sectional view taken along line 2—2 of FIG. 1.

First, with regard to the embodiment illustrated in FIGS. 1-6, there is shown a door 10 that is hinged as illustrated at 12 in FIG. 2. About the door 10 there is a door frame 14 including frame board 15.

Figure 3:
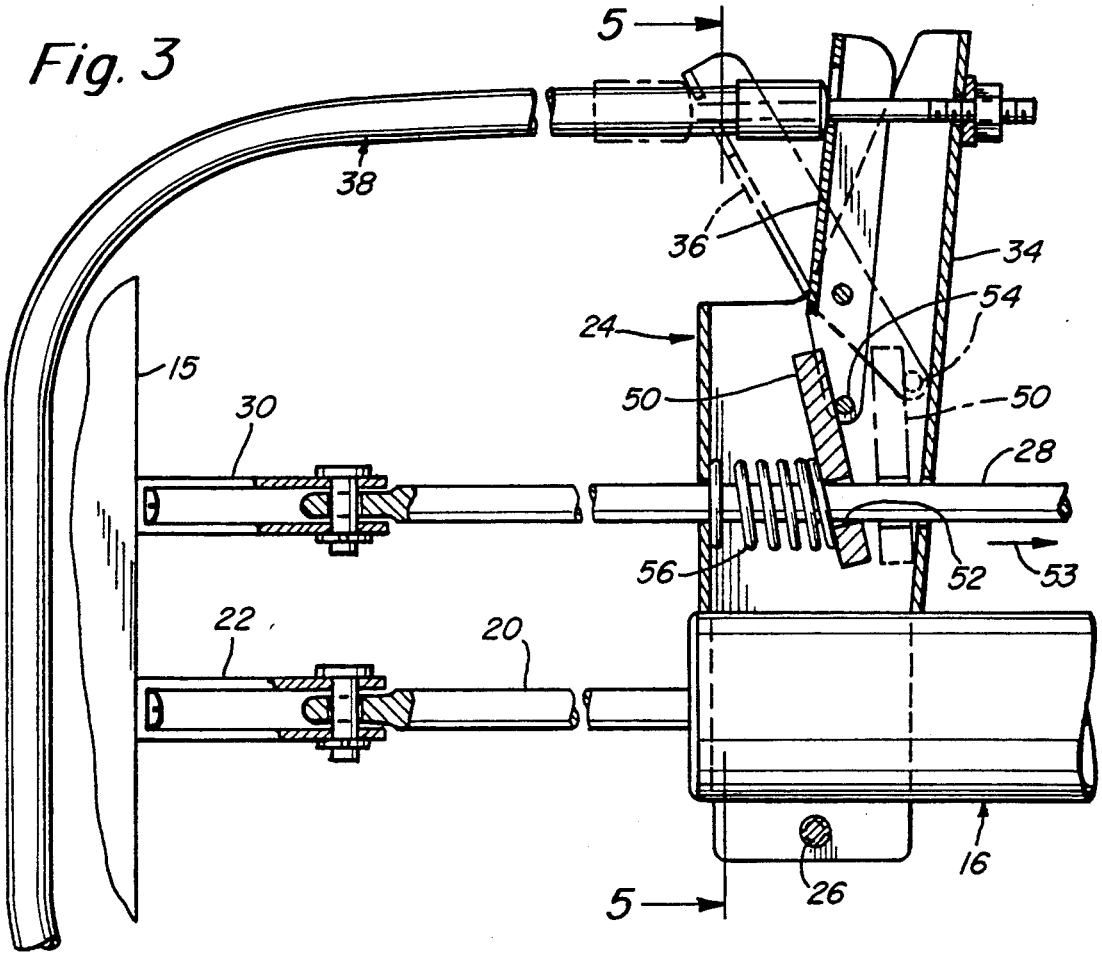
FIG. 3 is a cross-sectional view taken along line 3—3 of FIG. 1 showing further details of the lever member.

The door 10 in this embodiment of the invention is provided with a conventional piston unit 16. The piston unit 16 is attached by a bracket 18 at one end directly to the door. At the other end, the unit 16 includes a rod 20 that is secured by a further bracket 22 to the board 15. In this regard, refer to FIGS. 1 and 2. FIG. 3 also shows the bracket 22 secured to the board 15.

Figure 5:
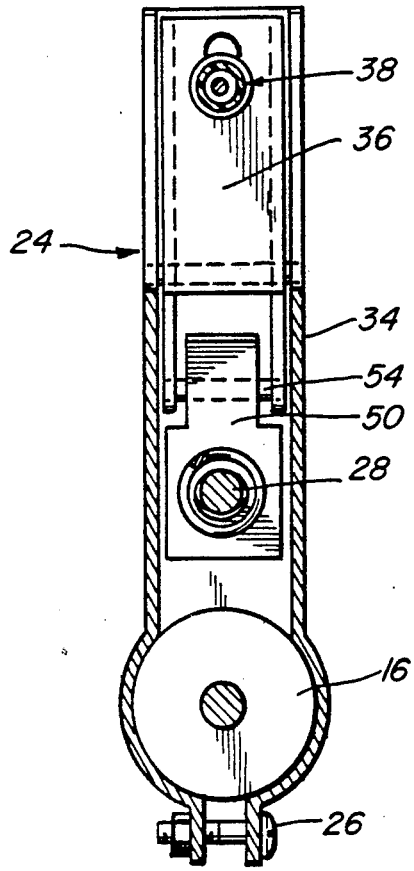
FIG. 5 is a cross-sectional view taken along line 5—5 of FIG. 3.
Figure 6:
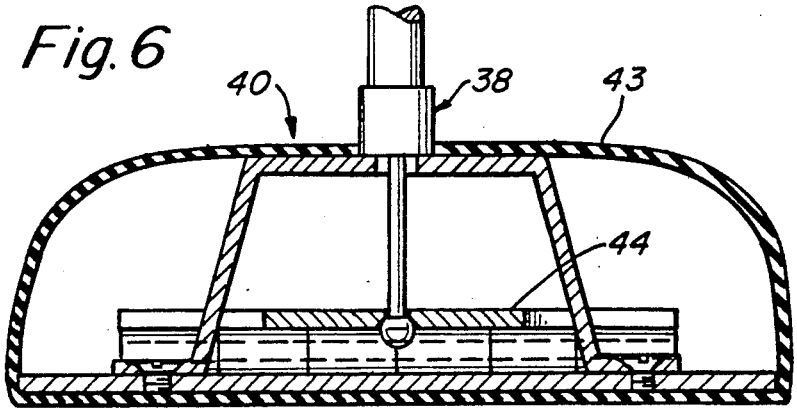
FIG. 6 is a cross-sectional view taken along line 6—6 of FIG. 4.

The holding means of the present invention includes a lever member 24 that is secured to the piston unit 16. For this purpose, there may be provided a securing bolt 26 as illustrated in FIGS. 3 and 5. The lever member 24 receives the rod 28 which extends therethrough as illustrated in FIG. 3. The rod 28 has a free end as illustrated in FIG. 1 and is secured at its other end to the board 15 by means of the bracket 30. Again, reference may be made to FIG. 3 that illustrates the bracket 30 and the rod 28.

The lever member 24 includes a housing 34 and a moveable lever 36. The lever 36 is operated in this embodiment from a mechanical cable arrangement including the cable assembly 38 illustrated in FIG. 3. The cable assembly 38 also connects to the actuating means 40 as illustrated in, for example, FIG. 4. The actuating means 40 will be described in further detail hereinafter.

FIGS. 2 and 3 illustrate the different positions of the door as well as the different positions of the lever member 24. More particularly, in FIG. 3, the lever 36 is shown in its solid position when the lever is actuated to hold the door. On the other hand, the lever 36 is shown in its phantom position to represent the position of the lever when it is essentially at rest, also identified herein as a released position.

Figure 4:
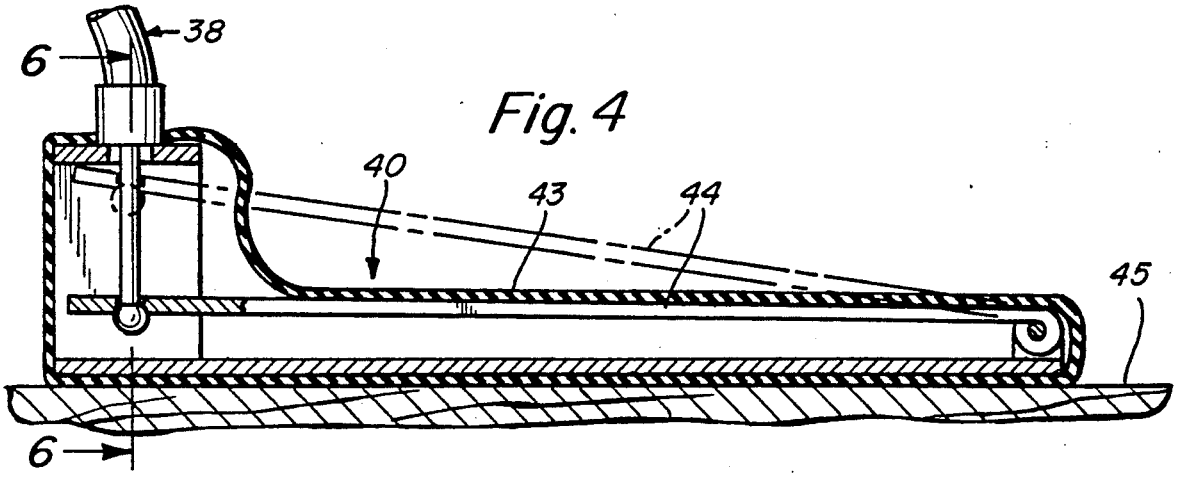
FIG. 4 is a cross-sectional view taken along line 4—4 of FIG. 1 showing further detail of the foot operated actuating means.

Reference is also now made to FIG. 4 which shows the actuating means. The actuating means 40 includes a mat that may have a plastic-type outer lining 43 covering a pivot piece 44. FIG. 4 shows the actuating means resting upon the floor 45. In this regard, also refer to FIG. 1.

It is noted that the plate 44 has a hole for receiving one end of the cable assembly 38. The cable assembly 38, as indicated previously, also connects up to the lever member 24 for actuation thereof. In FIG. 4 the plate 44 is shown in solid in its actuated position and is shown in phantom in its released position. Accordingly, when the foot steps upon the actuating means 40, the plate 44 moves down to its lower, in solid, position. This also moves the lever member 24 from its phantom position to its, in solid, position as illustrated in FIG. 3. This action likewise rotates the lever 36 from a first released position in which the binding plate 50 is more upright as viewed in FIG. 3 so that it does not bind with the rod 28. However, when the lever 36 is moved to its actuated position as shown in solid outline, then the binding plate 50 essentially tilts until the edge 52 essentially digs into the rod 28. The binding plate 50 is actuated from the pusher 54 which is attached to the lever 36.

Thus, by tilting the binding plate 50, it binds against the rod 28 and essentially locks the lever member 24 relative to the rod 28. This in turn holds the door in a predetermined opened position. From this position, the binding plate and its associated spring 56 are arranged so that if the door is opened more, the binding plate 50 is straightened somewhat to permit that. The lever 24 is permitted to move relative to the rod 28 in the direction of arrow 53 in FIG. 3. However, if the door is attempted to be closed further (a direction opposite to arrow 53), the binding plate 50 binds and does not permit closing of the door unless the actuating means 40 is released. When the actuating means 40 is released, then the lever 36 is moved to its phantom position with the binding plate 50 then straightening so that there is no binding with the rod 28.

Reference is now made to FIG. 7 for an alternate embodiment of the invention. In this embodiment of the invention, the door holder can be basically of the same construction as described previously. However, rather than being attached to the piston unit 16, the lever member is secured directly to the door. Thus, FIG. 7 shows a rod 60, supported by a bracket 62. The rod 60 extends through the holding member 64. The holding member 64 may be of the same type as described in FIG. 3 including a lever and associated binding plate. The housing of the means 64 is supported from a pivot bracket 66 which is attached to the door 68. FIG. 7 also shows the cable 69 that may be substantially the same as the cable assembly 38 illustrated previously in connection with the prior embodiment of the invention.

Lastly, FIG. 8 illustrates an alternate embodiment of the invention in which the lever member is operated by hydraulic means rather than by a cable assembly. This is shown schematically in FIG. 8 in which there is a hydraulic means 70 including a hydraulically-operated foot actuator 71 and a hydraulic line 72 that couples from foot operated actuator 71 and that would replace the mechanical mechanism illustrated in FIG. 4 herein. In the embodiment of FIG. 8, the hydraulic mechanism is shown in its expanded position with the foot pad actuated. In this position, it is noted that the lever 74 is pivoted so as to urge the binding plate 75 into binding engagement with a rod 76. The rod 76 is analogous to the rod 28 previously described in connection with the first embodiment of the invention.

In FIG. 8 the lever mechanism and binding plate are illustrated in full line in the activated position and in phantom in the released position. It is understood that the lever construction is substantially identical to the specific construction illustrated in FIG. 3. The primary difference between the embodiment of FIG. 3 and the one illustrated in FIG. 8 is that, rather than operation being by means of a cable, the lever is operated hydraulically from a hydraulic means.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A door holder for attachment to a door comprising:

a holding means including means secured to the door and means secured to a stationary structure adjacent to said door, said holding means including an actuable clamping means, engaging said means secured to a stationary structure, having a first released position in which the door is freely openable and closable and a second holding position in which the door is held open, said clamping means having means for clamping said means secured to a stationary structure only in one direction of relative movement therebetween to hold the door but enable further opening thereof; and foot-operated actuating means remote from said clamping means to move said clamping means from its first released position to its second holding position.

2. A door holder as set forth in claim 1 wherein said clamping means includes a lever member and said means secured to a stationary structure includes a rod means adapted to be received by said lever member.

3. A door holder as set forth in claim 2 wherein said means secured to the door includes means for securing said lever member to the door.

4. A door holder as set forth in claim 3 wherein said means for securing the lever member to the door includes a pivot piece.

5. A door holder as set forth in claim 2 wherein said means secured to the door includes means for securing the lever member to a door control piston unit.

6. A door holder as set forth in claim 2 wherein said rod means extends through said lever member, said lever member clamping said rod means in said second position.

7. A door holder as set forth in claim 6 wherein said lever member clamps said rod means only in one direction of movement of said rod means to hold the door open but enable only further opening thereof.

8. A door holder as set forth in claim 1 wherein said foot operated actuating means includes a foot operated mat having cable means extending therefrom to the holding means.

9. A door holder as set forth in claim 8 wherein said clamping means includes a lever member operated from said cable means.

10. A door holder as set forth in claim 9 wherein said means secured to a stationary structure includes a rod means adapted to be received by said lever member.

11. A door holder as set forth in claim 10 wherein said lever member includes a binding plate for locking said rod means against linear movement in one direction only.

12. A door holder as set forth in claim 1 wherein said foot operated actuating means includes a foot operated mat having hydraulic means extending therefrom to the holding means.

13. A door holder as set forth in claim 12 wherein said clamping means includes a lever member operated from said cable means.

14. A door holder as set forth in claim 13 wherein said means secured to a stationary structure includes a rod means adapted to be received by said lever member.

15. A door holder as set forth in claim 14 wherein said lever member includes a binding plate for locking said rod means against linear movement in one direction only.

16. A door holder as set forth in claim 1 wherein said clamping means includes a housing supporting a lever for controlling a binding plate; and further including a door piston unit which supports the housing.

17. A door holder for attachment to a door comprising:

a holding means including means secured to the door and means secured to a stationary structure adjacent to said door, said holding means including an actuable clamping means engaging said means secured to a stationary structure having a first released position in which the door is freely openable and closeable and a second holding position in which the door is held open, said clamping means having means for clamping said means secured to a stationary structure only in one direction of relative movement therebetween to hold the door but enable further opening thereof; and actuating means remote from said clamping means to move said clamping means from its first released position to its second holding position.

18. A door holder for attachment to a door comprising:

a holding means including means secured to the door and means secured to a stationary structure adjacent to said door, said holding means including an actuable clamping means engaging said means secured to a stationary structure, said clamping means having a first released position in which the door is freely openable and closeable and a second holding position in which the door is held open but can be opened further, said clamping means including a housing supporting a lever for controlling a binding plate and including a door piston unit which supports the housing; and foot-operated actuating means remote from said clamping means to move said clamping means from its first released position to its second holding position.

19. A door holder for attachment to a door comprising:

a holding means including means secured to the door and means secured to a stationary structure adjacent to said door, said holding means including an actuable clamping means engaging said means secured to a stationary structure having a first released position in which the door is freely openable and closeable and a second holding position in which the door is held open, foot-operated actuating means remote from said clamping means to move said clamping means from its first released position to its second holding position; and said foot-operated actuating means includes a foot-operated mat having hydraulic means extending therefrom to the holding means.

20. A door holder for attachment to a door comprising:

a holding means including means secured to the door and means secured to a stationary structure adjacent to said door, said holding means including an actuable clamping means engaging said means secured to a stationary structure, said clamping means having a first released position in which the door is freely openable and closeable and a second holding position in which the door is prevented from closing but can be opened further, and actuating means remote from said clamping means to move said clamping means from its first released position to its second holding position.

21. A door holder for attachment to a door comprising;

a holding means including means secured to the door and means secured to the stationary structure adjacent to said door, said holding means including an actuable clamping means, engaging said means secured to a stationary structure, having a first released position in which the door is freely openable and closeable and a second holding position in which the door is held open, and foot-operated actuating means remote from said clamping means to move said clamping means from its first released position to its second holding position, said clamping means including a lever member and said means secured to a stationary structure including a rod means adapted to be received by said lever member, said rod means extending through said lever member, said lever member clamping said rod means only in one direction of movement of said rod means to hold the door open but enable further opening thereof.

22. A door holder for attachment to a door comprising;

a holding means including means secured to the door and means secured to the stationary structure adjacent to said door, said holding means including an actuable clamping means, engaging said means secured to a stationary structure, having a first released position in which the door is freely openable and closeable and a second holding position in which the door is held open, foot-operated actuating means remote from said clamping means to move said clamping means from its first released position to its second holding position, said foot-operated actuating means includes a foot-operated mat having cable means extending therefrom to the holding means, said clamping means including a lever member operated from said cable means, said means secured to a stationary structure including a rod means adapted to be received by said lever member, and said lever member including a binding plate for locking said rod means against linear movement in one direction only.

23. A door holder for attachment to a door comprising; a holding means including means secured to the door and means secured to a stationary structure adjacent to said door, said holding means including an actuable clamping means, engaging said means secured to a stationary structure, having a first release position in which the door is freely openable and closeable and a second holding position in which the door is held open, and foot-operated actuating means remote from said clamping means to move said clamping means from its first released position to its second holding position, said foot-operated actuating means disposed in a stationary position independent of movement of said door.

24. A door holder for attachment to a door comprising:

a holding means including means secured to the door and means to a stationary structure adjacent to said door, said holding means including an actuable clamping means, engaging said means secured to a stationary structure, having a first released position in which the door is freely openable and closeable and a second holding position in which the door is prevented from closing but can be opened further, and actuating means remote from said clamping means to move said clamping means from its first released position to its second holding position, said actuating means disposed in a stationary position independent of movement of said door.

* * * * *